US008544687B2

(12) United States Patent
Sharp et al.

(10) Patent No.: US 8,544,687 B2
(45) Date of Patent: Oct. 1, 2013

(54) DISPLAY CARD WITH VISCOUS MATERIAL DISPENSER

(75) Inventors: Phillip Neal Sharp, Sunnyvale, CA (US); Sven Newman, Burlingame, CA (US); David C. Thomsen, San Mateo, CA (US); Anita G Mooy, Charlotte, NC (US); Jeffrey J. Davis, Cornelius, NC (US)

(73) Assignee: Momentive Performance Materials, Inc., Albany, NY (US)

( * ) Notice: Subject to any disclaimer, the term of this patent is extended or adjusted under 35 U.S.C. 154(b) by 1119 days.

(21) Appl. No.: 12/200,376

(22) Filed: Aug. 28, 2008

(65) Prior Publication Data

US 2009/0071978 A1 Mar. 19, 2009

Related U.S. Application Data

(60) Provisional application No. 60/969,232, filed on Aug. 31, 2007.

(51) Int. Cl.
*B65D 35/28* (2006.01)

(52) U.S. Cl.
USPC ..... 222/103; 222/107; 222/541.9

(58) Field of Classification Search
USPC ..... 222/541.9, 103, 107, 541.6, 92, 95, 222/541.1; 206/223
See application file for complete search history.

(56) References Cited

U.S. PATENT DOCUMENTS

| | | | | | |
|---|---|---|---|---|---|
| 3,741,384 | A | * | 6/1973 | Cloud | 206/461 |
| 3,913,734 | A | * | 10/1975 | Siegel | 206/470 |
| 3,986,640 | A | | 10/1976 | Redmond | |
| 4,148,417 | A | | 4/1979 | Simmons | |
| 4,236,652 | A | | 12/1980 | Beguhn | |
| 4,671,026 | A | | 6/1987 | Wissinger | |
| 4,817,344 | A | | 4/1989 | Wissinger | |
| 4,863,014 | A | | 9/1989 | Simmons | |
| 4,921,137 | A | * | 5/1990 | Heijenga | 222/107 |
| 4,974,732 | A | | 12/1990 | Sullivan | |
| 4,979,656 | A | * | 12/1990 | Looker | 222/541.2 |
| 5,034,455 | A | | 7/1991 | Stein | |
| 5,180,063 | A | | 1/1993 | Sakno | |
| 5,228,782 | A | | 7/1993 | Imer | |

(Continued)

FOREIGN PATENT DOCUMENTS

| | | | |
|---|---|---|---|
| JP | 2001-018989 | | 1/2001 |
| JP | 2001018989 | A * | 1/2001 |
| WO | WO92/09494 | | 6/1992 |

OTHER PUBLICATIONS

English translation of JP 2001-018989.*

(Continued)

*Primary Examiner* — Paul R Durand
*Assistant Examiner* — Robert Nichols, II
(74) *Attorney, Agent, or Firm* — Philip D. Freedman; Philip D. Freedman PC; Kenneth S. Wheelock

(57) ABSTRACT

An article of manufacture for dispensing a viscous material, comprising; a display card comprising at least one first crease at least partially along an axis of the card; and a viscous material dispenser, comprising a container suspended from the display card along the at least one first crease to permit folding the card at the crease to compress the container to express material from the container through a container tip.

14 Claims, 4 Drawing Sheets

(56) References Cited

U.S. PATENT DOCUMENTS

| | | | | |
|---|---|---|---|---|
| 5,654,082 | A | 8/1997 | Kagawa | |
| 5,996,845 | A * | 12/1999 | Chan | 222/107 |
| 6,007,264 | A * | 12/1999 | Koptis | 401/132 |
| 6,090,451 | A | 7/2000 | Barth | |
| 6,241,287 | B1 | 6/2001 | Best | |
| 6,269,654 | B1 | 8/2001 | Murray | |
| 6,305,132 | B1 | 10/2001 | Smith | |
| 6,305,577 | B1 | 10/2001 | Fillmore | |
| 6,451,440 | B2 | 9/2002 | Atwood | |
| 6,557,731 | B1 * | 5/2003 | Lyon et al. | 222/94 |
| 6,659,278 | B1 | 12/2003 | Vellliquette | |
| 6,662,948 | B1 | 12/2003 | Vellliquette | |
| 7,325,703 | B2 * | 2/2008 | Gherdan et al. | 222/94 |
| 8,151,984 | B2 * | 4/2012 | Braeder et al. | 206/219 |
| 2001/0038020 | A1 | 11/2001 | Schalow | |
| 2001/0048198 | A1 | 12/2001 | Dulin | |
| 2001/0049427 | A1 | 12/2001 | Atwood et al. | |
| 2003/0089625 | A1 | 5/2003 | Moodie | |
| 2004/0226968 | A1 | 11/2004 | LaFond | |
| 2005/0152624 | A1 | 7/2005 | Versluys | |
| 2005/0217034 | A1 | 10/2005 | Miller | |
| 2006/0226171 | A1 | 10/2006 | Sternberg | |
| 2008/0197042 | A1 | 8/2008 | Ullrich | |

OTHER PUBLICATIONS

ISR PCT 09/60541, Sep. 12, 2009, Momentive Performance Materials Inc.

* cited by examiner

FIG. 7
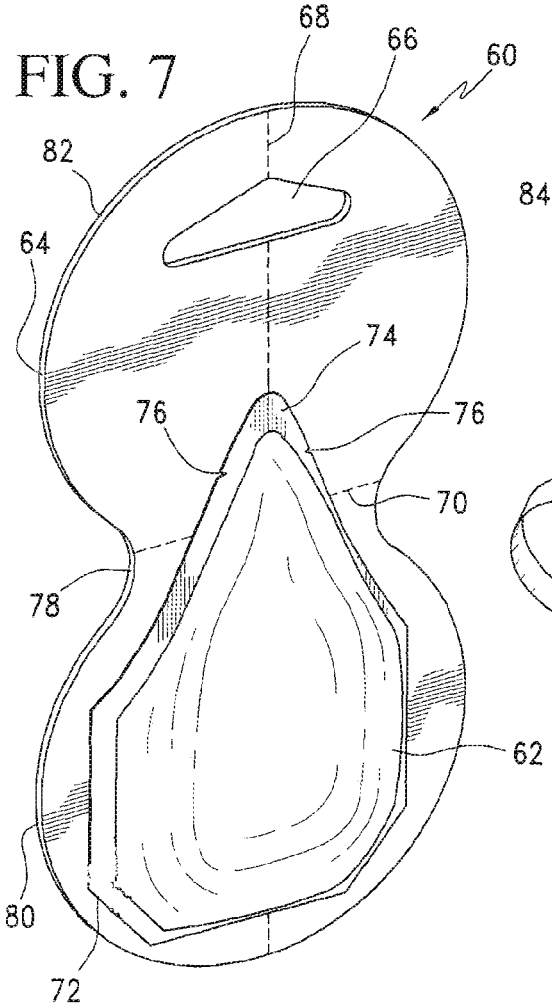
FIG. 10
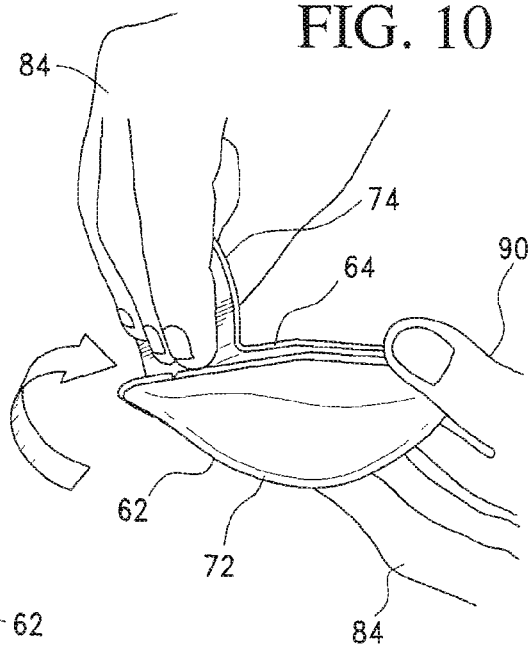
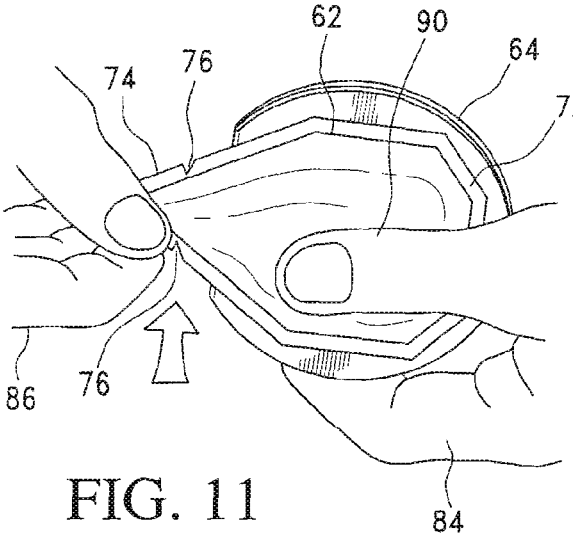
FIG. 11
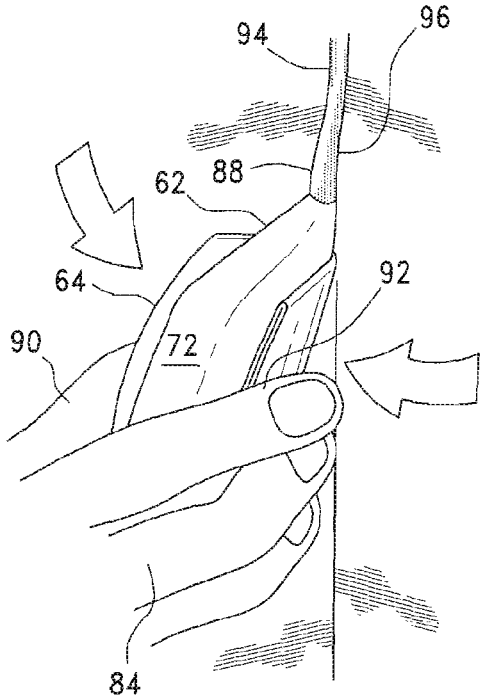
FIG. 12

DISPLAY CARD WITH VISCOUS MATERIAL DISPENSER

This application claims the benefit of U.S. Provisional Application No. 60/969,232, filed 31 Aug. 2007, which is incorporated herein by reference.

BACKGROUND OF THE INVENTION

The invention relates to a viscous material dispenser, kit and method and more particularly to a dispenser, kit and method for dispensing a sealant.

Viscous materials can include sealant, mastic, adhesive, glazing, caulk, grout and glue compositions. Typically, such viscous materials are packaged stored or commercialized in cardboard containers or plastic dispensers or cartridges that are adapted to be loaded into an extrusion device such as a caulking gun. These viscous materials include silicone sealants and caulks that are used in building and constriction applications. Some of these compositions are referred to as room temperature vulcanizable (RTV) compositions. They may include a moisture-curable polyorganosiloxane polymer, filler, and a condensation cure catalyst. When used as sealants, these compositions can be packaged in a moisture impervious tube and applied to a substrate by extrusion from the packaging tube.

There are difficulties associated with these containers. For example, some materials are merchandised in cartridges for loading into a caulk dispenser or gun. The dispenser or gun is another item that must be purchased, stored, cleaned and maintained as part of the caulking process. The dispenser or gun may be cumbersome and difficult to operate, especially in constrained spaces in buildings under construction. Also, the dispensing device may require significant hand strength, which adds challenge to dispensing and laying a clean sealant bead.

In one process, a quantity of sealant is expressed from a dispensing tube or cartridge directly to a crevice to seal the area when dried. Typically, the dispensing tube or cartridge will contain more material than an amount required for a particular sealing job. Usually some unused portion of the tube remains after a required amount has been dispensed. The dispensing tube with the unused portion is discarded or is saved for futures use. Discarding is uneconomical and may be highly undesirable for environmental reasons. At present, there is no known recycling available for the wide variety of sealant compositions available on the market.

If the container with residual sealant is not discarded, it will need to be capped to save the material without setting for future use. But, the sealant may include a volatile component that will evaporation to harden residual material. Other sealants may be settable from exposure to atmosphere oxygen. And unless the container is correctly reclosed, the residual material will be lost.

Some dispensing containers are merchandized with a nozzle-engaging, snap-fit bead and groove or screw thread to provide a secure fit to the container body. But these caps are fragile pieces that are easily split or otherwise damaged from over-tightening. Or, the snap-fit bead and groove may not provide an enduring reclose fit until the time when the tube is next required for a caulk job. Some informal capping devices have included the placing of a nail into the tube opening, to effect a plug type reclosure. Or, the container cap may be merchandised with a plug member to provide this function. But frequently, these solutions do not prevent content hardening for more than a short period of time.

Other reclosing approaches have included wrapping the container tip with aluminum foil or plastic wrap, secured with a rubber band and enclosing the entire container in a sealable plastic packet. But, oftentimes these mechanisms do not work because the packets rupture or the packets contain enough air to dry the tube contents. And, a foil or wrap can not be closely and tightly wrapped around the tube and nozzle without air gap.

There is a need for a viscous material container that overcomes the problems of waste and difficulty of use of current dispensers. Also, many merchandising containers are unduly expensive. There is a need for a reasonably priced solution to these viscous material container problems.

BRIEF DESCRIPTION OF THE INVENTION

The invention provides a display card with a viscous material container and method to overcome current problems of waste, cost and difficulty of use.

The invention can be described as an article of manufacture for dispensing a viscous material, comprising; a display card comprising at least one first crease at least partially along an axis of the card; and a viscous material dispenser, comprising a container suspended from the display card along the at least one first crease to permit folding the card at the crease to compress the container to express material from the container through a container tip.

In an embodiment, the invention is a method of applying a sealant, comprising: providing a viscous material dispenser, comprising a container suspended from a display card along a crease on the card; and folding the card at the crease to compress the container to express material from the container.

In another embodiment, the invention is a method of applying a sealant, comprising: identifying a sealant job; selecting a packet from a display of packets of differing sizes each suspended from a display card and containing differing sealant contents, wherein a packet is selected having a quantity of sealant to accomplish the job without substantial unused sealant; and expressing sealant from the packet to the job.

BRIEF DESCRIPTION OF THE DRAWING

FIG. 7 is a perspective view of an article of manufacture for dispensing a viscous material and FIG. 8 and FIG. 9 are respectively front and back elevation views of the article of manufacture; and FIG. 10, FIG. 11 and FIG. 12 illustrate a method of applying a sealant to a job.

DETAILED DESCRIPTION OF THE INVENTION

The term sealant as used herein includes an entire variety of caulks including silicones, latex and acrylic caulk; filler compounds; adhesive or mastic-type materials, such as stucco, concrete and cementious-material patching and crack-filling compounds; gasketing compounds; gutter, flashing, skylight or fish tank seam or sealant compounds; butyl or rubber sealants, cements and caulk; roof cements; panel and construction adhesives; glazing compounds and caulks; gutter and lap sealants; silica gel-based firebrick, masonry and ceramic crack fillers and cements; silicone-based glues; ethylene glycol-containing latex glazing compounds; and the like.

One preferred sealant is an organopolysiloxane room temperature vulcanizable (RTV) composition. The room temperature vulcanizable silicone elastomer composition can contain a silanol stopped base polymer or elastomer, reinforcing and/or extending filler, cross-linking silane and cure catalyst. These RTV compositions are prepared by mixing diorganopolysiloxanes having reactive end groups with organosilicon compounds that possess at least three hydrolyzably reactive moieties per molecule. The known RTV compositions are widely used as elastic sealing materials for applications involving the gaps between various joints such as the gaps between the joints of building materials, the joints between structural bodies and building materials in buildings, between the bathtub and wall or floor, cracks on tiles in bathrooms, gaps in the bathroom such as those around the washbasin and those between the washbasin supporting board and the wall, gaps around the kitchen sink and the vicinity, between panels in automobiles, railroad vehicles, airplanes, ships, gaps between prefabricated panels in various electric appliances, machines, and the like. Room temperature vulcanizable silicone sealants thus may be utilized in a wide variety of caulking and sealing applications.

Features of the invention will become apparent from the drawings and following detailed discussion, which by way of example without limitation describe preferred embodiments of the invention.

Figure 1:
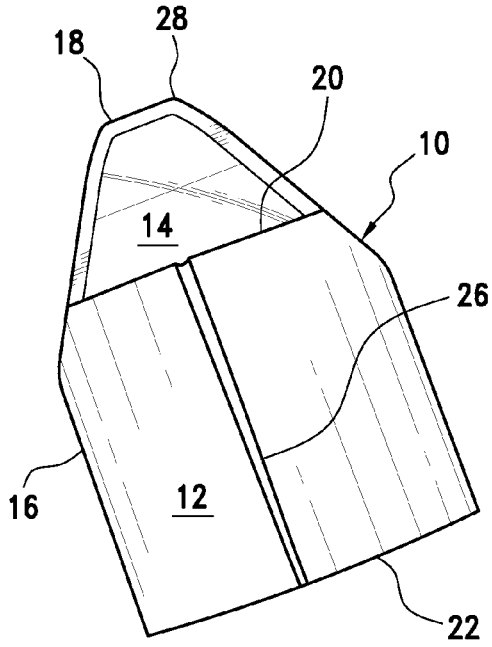
FIG. 1 is a front elevation view of a packet.
Figure 2:
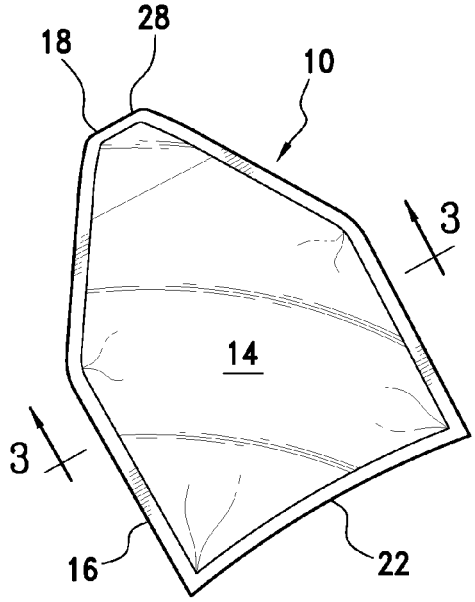
FIG. 2 is a rear elevation view.
Figure 3:
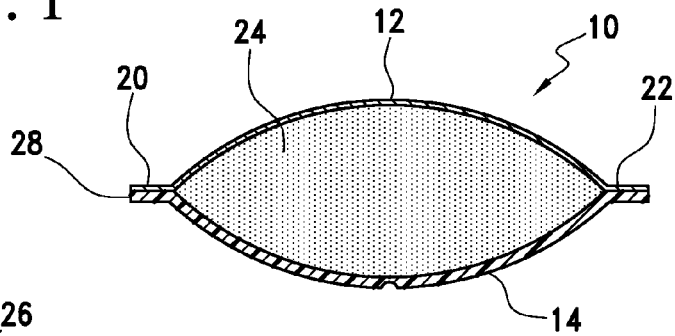
FIG. 3 is a cut away view of the packet through 3-3 of FIG. 2.

FIG. 1, FIG. 2 and FIG. 3 illustrate an embodiment of the invention. FIG. 1 is a front elevation of a viscous material dispenser according to the invention. The dispenser is in the form of a packet 10. FIG. 2 is an elevation of the packet 10 from a back side. The packet 10 comprises a pouch 14 that comprises two thin sidewalls of plastic or foil film and a supporting card flat 12. The films of pouch 14 can be heat-sealed or otherwise connected together along edge 16 as shown in FIG. 3 with closure end 22 that form an expressing shape tip 18. Or, the pouch 18 can be formed from a single film that is folded into the pouch 18 shape.

Materials suitable for pouch 18 include single layer, co-extruded or laminated film or foil. The films can include polyethylene, polypropylene, polystyrene and poly-ethylene-terephthalate, as examples. The foil is a thin, flexible leaf or sheet of metal such as aluminum foil for example. Other suitable pouch 18 materials include a plastic film, such as low-density polyethylene or other thermoplastic or foil film material. In one embodiment, the film is a polyethylene and bioriented polypropylene coextruded film.

An aluminum foil is a preferred pouch 18 film material. Suitable film can be derived from aluminum prepared in thin sheets with a thickness less than 0.2 mm/0.008 in, although much thinner gauges down to 0.006 mm can be used. A suitable foil can comprise a laminate with other materials such as a plastic or paper.

The pouch 18 material can be impermeable or only slightly permeable to water vapor and oxygen to assure content viability. For example, the film can have a moisture vapor transport rate (MVTR, ASTM D3833) of less than 10 g/day/$m^2$. In an embodiment, the MVTR of the film less than 5 g/day/$m^2$ and preferably less than 1 g/day/$m^2$ and most preferably of less than 0.5 g/day/$m^2$.

The pouch 18 film can be of various thicknesses. The film thickness can be between 10 and 150 μm, preferably between 15 and 120 μm, more preferably between 20 and 100 μm, even more preferably between 25 and 80 μm and most preferably between 30 and 40 μm.

The card 12 of packet 10 includes a crease 26 running longitudinally to the packet 10 from closure end 22 toward the first card end 20. A crease 26 is marked into the card 12 surface to facilitate longitudinal folding of the packet 10, as hereinafter described. The crease 26 can be a pressed, folded, wrinkled, embossed line or score. The crease 26 can run generally longitudinally to a long axis of the packet 10 from closure end 22 of the packet 10 toward the nozzle 18 first card end 20.

FIG. 3 is a cut away side view of the packet 10 showing pouch 18 containing a sealant 24. The card 12 can be pleated or fluted (not shown) to allow for an increased volume of sealant 24. The packet 10 is creased 26 in the middle to allow for folding as hereinafter described. Nozzle 28 is formed from tapering end of pouch 14. The nozzle 28 can be a heat seal closure that can be opened by tearing or cutting with scissors or a knife or simply from pressure of sealant 24 expanding into and then from the nozzle 28. Or in an embodiment, the nozzle 28 can be closed by serrated embossing to provide for easy tear opening.

A portion 30 of the dispenser toward the closure end 22 can comprise a more rigid or thicker material to impart added structure and strength. For example, the portion 30 can comprise a multiple laminated film that is the same film as the rest of the dispenser. Or, the portion 30 can comprise a different film that is more dense than the film of the rest of the dispenser.

Figure 4:
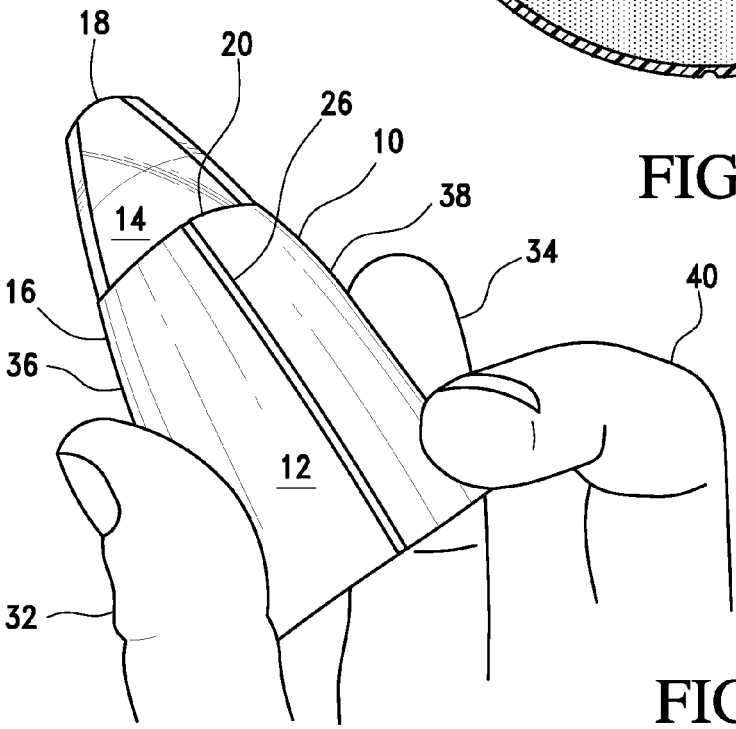
FIG. 4 and FIG. 5 are schematic perspective views of a use of the packet.
Figure 5:
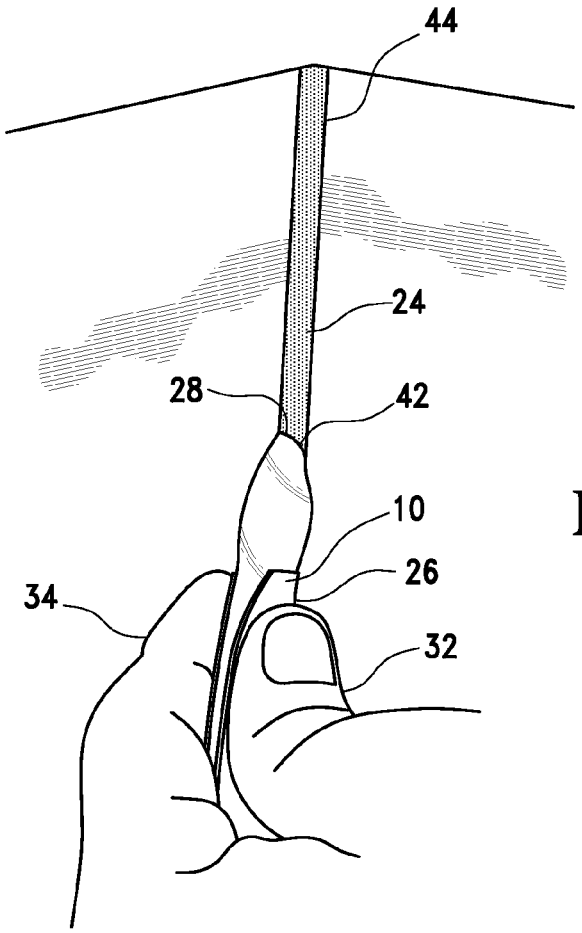

FIG. 4 and FIG. 5 illustrate an application method using the packet 10 of FIG. 1, FIG. 2 and FIG. 3. As illustrated, the packet 10 can be grasped with thumb 32 and third finger 40 located on opposing sides 36, 38 of packet 10 edge 16. Then the packet 10 is folded along crease 26 by applying a force with the thumb 32 and second finger 40 to the opposing edges 36, 38. Folding can be facilitated by a user imposing the length of an index finger 34 against the pouch 14 opposite crease 26 while side force is applied by thumb 32 and second finger 40 and then switching the index finger to fold the pouch 14 between the second finger 40 and thumb 32. The folding drives enclosed sealant 24 from within pouch 18 to be expressed through nozzle 28. Initially, the sealant 24 can be contained within the pouch 18 of the packet 10 and the nozzle 28 can be flat and devoid of sealant 24. But, when the packet 10 is folded and pressed as shown in FIG. 5, the sealant is forced into the nozzle 28, which becomes conical in shape. The conical shape provides increased stability for further controlling the expressing of sealant 24 out the nozzle 28 tip to form a desired sealant bead 44 shape. The substantially rigid structure formed from the over folding of two sides of the packet 10 can be firmly held while expressing to maneuver the packet 10 and to control location and shape of an applied sealant bead. The nozzle 24 can be shaped to allow sealant to fill the rest of the nozzle and flow from the tip. The nozzle can be shaped to an appropriate bead size, for example, $1/8^{th}$ inch in diameter. The user can further regulate bead size by applied pressure and speed.

Figure 6:
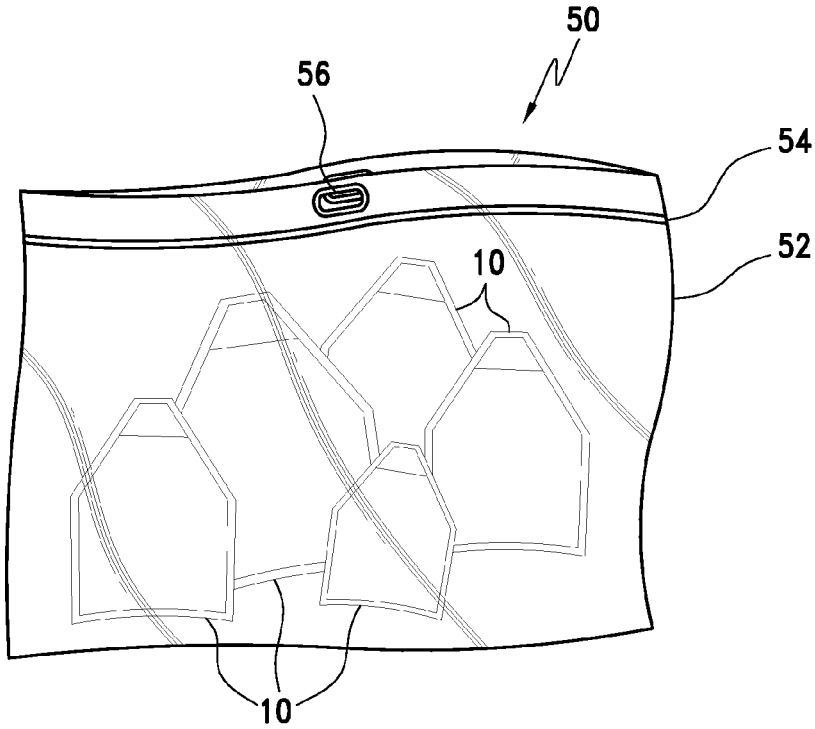
FIG. 6 is a perspective view of a kit with a plurality of packets.

The size of packet 10 can vary but can be about 24 cm by 15 cm or smaller. For example, FIG. 6 illustrates an embodiment of the invention wherein a plurality of packets 10 are provided in a kit 50. The kit 50 includes bag 52 sealable at seal 54 and with eye 56 for hanging when merchandised. The plurality of packets 10 can be the same shape or a variety of shapes or the same size or a variety of sizes, for example 8 cm×6 cm or 4 cm by 2 cm to provide measured amounts of sealant for a variety of jobs. The kit 50 provides a variety of packets 10 so that one packet 10 can be selected to match the requirements of any particular job.

A selected packet from a kit of the invention can provide a desired amount of sealant for any particular job. No caulk gun is heeded to apply the sealant. Indeed, no extra tools or materials are needed. The packet is relatively small and easily maneuverable to apply an appropriate bead. The packet requires little application force for dispensing and in most instances, sealant can be fully dispensed by one hand. The need to save left over, unused caulk is eliminated. Both kit and packet packaging are inexpensive.

Figure 8:
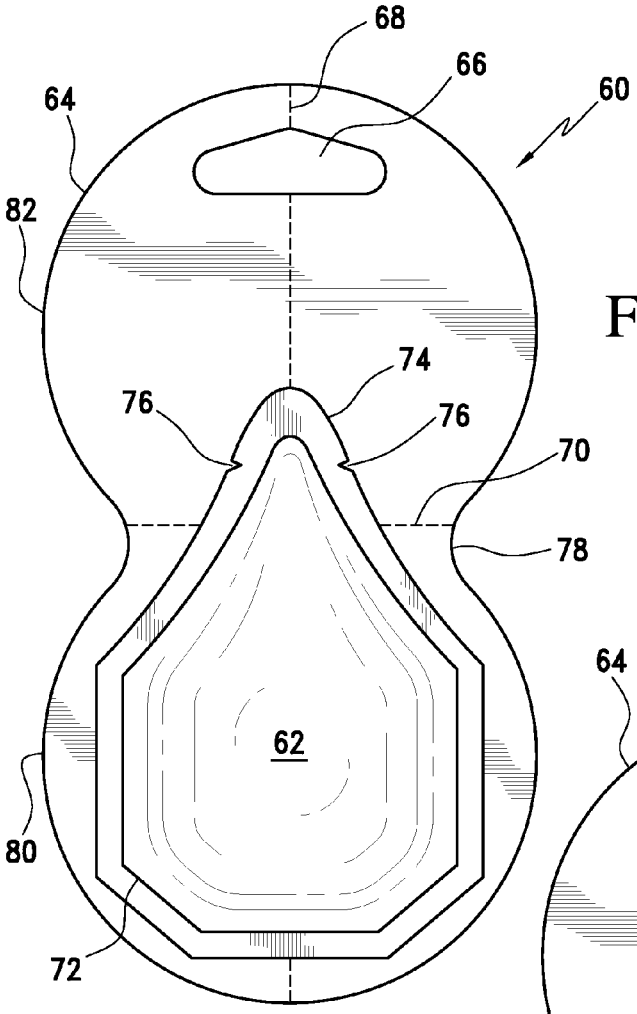
Figure 9:
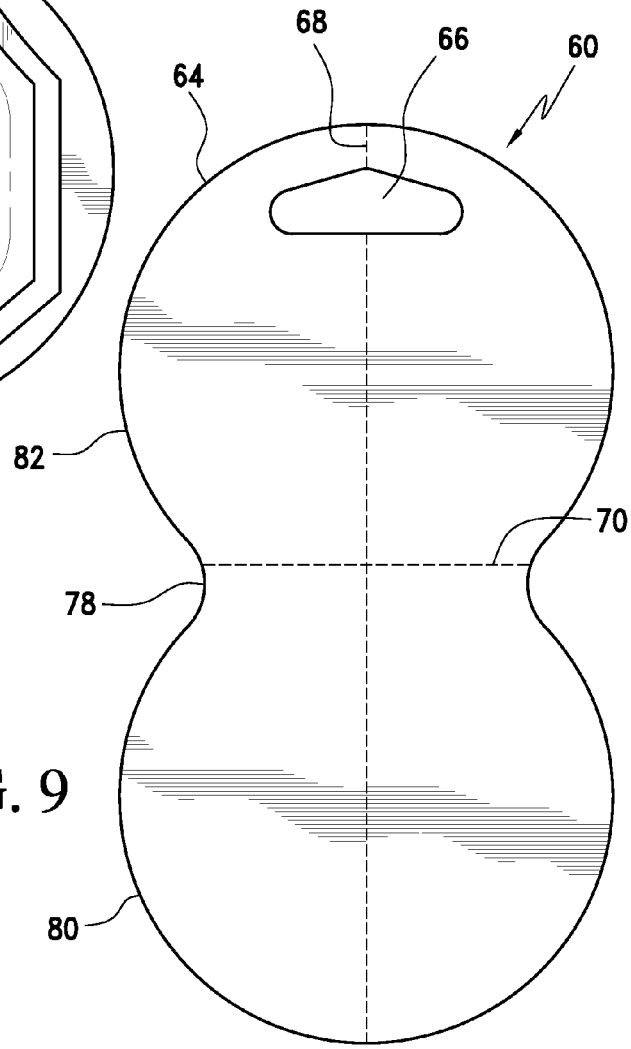

FIGS. 7 to 12 illustrate another preferred embodiment of the invention. FIG. 7 is a perspective view and FIGS. 8 and 9 are respectively front and rear elevation views of an article of manufacture 60 for a viscous material packet 62 with a display card 64. The card 64 can comprise any suitable rigid or semi-rigid material such as cardboard, paperboard, corrugated board and any wood-based type of paper or rigid or semi-rigid plastic sheet material. The packet 62 can be any of the packets 10 of FIGS. 1 to 6.

Ihe display card 64 includes eyelet 66, which is shown triangular in shape to facilitate stable hanging from a hook, nail, tack or the like. While eyelet 66 is shown triangular, it can be round, oval or irregular in shape or any other suitable configuration to permit suspending the card 64 from a display book. Advantageously, the eyelet 66 permits hanging the article 60 so that the article can self merchandize itself as well as provide a dispensing function as hereinafter described with reference to FIGS. 10, 11 and 12.

As further shown on the front and rear elevations, FIGS. 8 and 9, the card 64 has crease lines 68 and 70. First crease 68 runs longitudinally to the card 64, from bottom to the eyelet 66 top. A second crease 70 runs perpendicular to the first crease 68 across the width of the card 64. A viscous material packet 62 is attached to the card 64 by adhesive, glue or the like. The orientation of the packet 62 to card 64 and creases 68 and 70 can be important. Packet 62 includes pouch 72 and tip 74. The tip 74 is a tip-shaped section of the pouch 72 defined by side insets 76 that facilitate tearing away of the tip at the insets to expose material held within the pouch.

As shown, the packet is affixed along the card 64 first crease 68 with tip 72 located to extend across and beyond the second crease 70 and toward the card 64 eyelet 66 end. Either crease can be a pressed, folded, wrinkled line that is embossed or scored into the card 64 body to facilitate folding as hereinafter described. The card 64 is substantially hour-glass shaped with a narrower waist section 78 at about the location of the second crease 70, expanded bottom section 80 that provides a rest for a material holding pouch 72 of packet 62 and an expanded upper section 82 that supports tip 74 and provides structure for stable hanging of the product merchandizing article via the eyelet 66. While the pouch is adhered to the bottom section 80 by adhesive, glue or other attachment, any portion of the pouch 72 and tip 74 that extends beyond the second crease 70 toward the eyelet 66 end of the card 64 rests on but is free from the body of the card 64.

FIGS. 10, 11 and 12 illustrate using the article of manufacture 60 shown in FIGS. 7, 8 and 9. According to the procedure illustrate in FIGS. 10, 11 and 12, first, upper section 82 of the display card 64 is folded at second crease 70 away from the unattached tip 74 of pouch 72. A user can hold the bottom section 80 of the upside down card 64 in one hand 84 and turn the upper section 82 of the card 64 upward and away from the unattached pouch tip 74 with another hand 86 as shown in FIG. 10. In FIG. 11, tip 74 is torn from the pouch 72 by twisting or ripping (see arrow) at the insets 76 to expose the pouch 72 interior and the material 88 held in the interior. Then the user's index finger 92 can be imposed against the pouch substantially parallel to its longitudinal axis and consequently against the first crease 68 of the display card 64.

The crease 68 is not shown in FIG. 11 beneath the pouch 72, but is illustrated in FIGS. 8 and 9 and then again is show as a display card 64 folding point in FIG. 12. As illustrated in FIG. 11, the index finger 92 imposes against the packet 62 and card 64 to commence folding of the card 64 along crease 68. Then the user grasps the folding card 64 between thumb 90 and index finger 92 (and second and third fingers if needed) to collapse (arrows) the card 64 against the pouch 72. Folding the card 64 at the crease 68 to collapse the card 64 against the pouch 72 compresses the pouch 72 to express material 88 through the open tip 74. Express of the material 88 from the pouch 72 is accurately controlled by compression of the thumb 90 and index finger 92 to provide an even and accurate bead 94 of material 88 to precisely seal any seam 96 in need of repair.

The following Example is illustrative and should not be construed as a limitation on the scope of the claims.

EXAMPLE 1

Packet samples are evaluated to establish a design for dispensing a viscous material.

The samples are constructed from clear polypropylene Ziploc® packets, thin (<1 mm) black polypropylene and polyethylene sheet and acrylic thin film (<1 mm). The sheet materials are formed and heat sealed into packet shapes by first cutting oversized top and bottom rectangular shapes with triangular ends and heat sealing the pieces together with the triangular ends at one side to form a nozzle. Some of the packets are formed with gussets. The gussets are formed by folding the film at the packet sides and bottom.

Excess material is cut away from the packet after forming. Each packet is filled with material and then heat sealed to form an enclosure. The packets vary in length from about 4 cm to 20 cm, in width from about 2 cm to 15 cm and in thickness (filled with material) from about 0.5 cm to 2 cm. The packets are filled with acrylic caulk or silicone sealant.

A panel of evaluators is assembled to evaluate each packet from an array of 20 to 30. The packets are evaluated for content integrity and ease and control of material expression. In the evaluation the panel visually and tactilely inspects each packet before dispensing material. Then members of the panel fold each packet to express its contents. The panel notes ease of control of expression of the material bead onto a test cardboard. Also, the panel observes any failure in packet integrity.

The packets are evaluated for dispersing both acrylic caulk and silicone sealant. The panel practices multiple dispensing for each configured packet. The panel then approves a selection of packets for next step evaluation. The process is reiterated with successive packets constructed according to characteristics of successful packets from a round of a previous evaluation.

The panel identifies packet designs that do not fully fill with material, do not form a round orifice for expressing a uniform bead and are insufficiently flexible to fully fill. Some expressing faults are addressed by changing nozzle angle and length in packets for subsequent evaluation rounds. Some first round designs are observed as too flimsy to allow for fine control needed to dispense a continuous smooth bead of material. This is addressed by (1) making one of the surfaces of the packet out of a more rigid plastic sheet, and (2) modifying user interaction to fold the packet along the crease length to provide an even more rigid dispensing structure.

Some designs are noted as having too thin a film. With these packets, the material resists sliding inside the packet thus making it difficult to completely express packet contents. This problem is addressed with a gusset designed packet to increase the volume of the packet while maintaining or decreasing the packet internal surface area.

A creased semi-rigid plastic backing for the packet is determined as a best design to hold a desired quantity of material and to ease folding for dispensing. The packet is sized overall (7 cm×5 cm×1.5 cm) to be manipulated to completely express material with one hand. The selected dispenser nozzle has a longer, 2 cm and narrower, 1 cm nozzle to allow the packet to be squeezed without nozzle deformation. And, the selected packet design has gussets on the sides to increase volume while minimizing internal surface area, so that material can be dispensed by one hand finger compression.

EXAMPLE 2

A resulting design was functionally tested by others that represented a consumer panel. Ten packets of the design were distributed among 6 persons of the panel. Each person was instructed to express material from a packet according to a procedure of manually pressing the packet with one hand with an index finger along the crease to fold the packet longitudinally to express the sealant from the packet nozzle.

A jury of designers observed the expressing procedures and noted the panel's comments. The consumer panel responses were filmed to capture use of the packet and comments The panel approved the proposed design. The following panel comments on the design were recorded: "This is really nice! I'm digging this." "I think that's kind of amazing. I can only say good things about it." "Super easy to use. I love the bead that it gave me. It feels like I have a lot of control." "I like this already, and I'll tell you why. Because you can really manipulate the pressure. You can do a lot, or you can do a little." "You've addressed the issue of most people at home not needing a huge quantity [of caulk]." "Once you get used to using these, as you can see already on my first run, you're pretty much a professional."

This EXAMPLE illustrates a prospective commercial success for a viscous dispenser according to the invention.

While preferred embodiments of the invention have been described, the present invention is capable of variation and modification and therefore should not be limited to the precise details of the Examples. The invention includes changes and alterations that fall within the purview of the following claims.

What is claimed is:

1. An article of manufacture for dispensing a viscous material, comprising:

a display card with an expanded upper section, the card comprising cardboard or paperboard and having at least one first crease completely extending the longitudinal axis of the display card and at least one second crease intersecting the at least one first crease and running substantially perpendicular to the first crease completely across the width of the card; and a viscous material dispenser comprising a pouch with a tip, the pouch suspended from and attached to the display card solely along one side to permit folding the card at the first crease to compress the pouch to express material from the pouch through the pouch tip, with an upper portion resting on but free from the body of the display card except for the single side attachment, and the display card being substantially hour-glass shaped with a narrower waist section located at the at least one second crease, the tip supported by an upper section of the display card and extending over and beyond the at least one second crease of the card toward an eyelet end of the display card.

2. The article of claim 1, wherein the pouch has at least two opposing sidewalls; a first closure end; and a second closure end; the sidewalls and closure ends defining an enclosure, and at least one closure end comprising a nozzle with the tip.

3. The article of claim 1, wherein a crease is a pressed, folded, wrinkled line that is embossed or scored into a surface of the card to facilitate folding of the card.

4. The article of claim 1, wherein the pouch holds an amount of caulk sealant proportioned or measured to seal an identified job.

5. The article of claim 1, wherein the pouch comprises a first closure and an expressing shape formed integrally with one another, the expressing shape projecting longitudinally of the pouch and being centrally located on the first closure.

6. The article of claim 1, wherein a pouch sidewall is flexible to be collapsed against itself and creased at the display card first crease line.

7. The article of claim 1, wherein the pouch holds a sealant.

8. The article of claim 1, wherein the pouch holds an acrylic or silicone sealant.

9. The article of claim 1, wherein the pouch holds a sealant comprising an RTV composition.

10. The article of claim 1, wherein the pouch holds a sealant comprising a polysiloxane component comprising a mixture or reaction product of (i) a polysiloxane polymer having hydrolyzable substituent groups and (ii) a polyfunctional silicon compound having two or more hydrolysable substituent groups.

11. The article of claim 1, wherein the pouch holds a sealant comprising a polysiloxane component comprising a mixture or reaction product of (i) a polysiloxane polymer having hydrolyzable substituent groups and (ii) a polyfunctional silicon compound having two or more hydrolysable substituent groups and includes a filler.

12. The article of claim 1, wherein the pouch holds a sealant comprising a polysiloxane component comprising a mixture or reaction product of (i) a polysiloxane polymer having hydrolyzable substituent groups and (ii) polyfunctional silicon compound having two or more hydrolysable substituent groups and includes a filler and a condensation cure catalyst.

13. The article of claim 1, wherein the pouch is elongated with a longitudinal axis and an interior, a surrounding sidewall, a first closure forming a downstream end of the pouch and a second closure forming an upstream end of the pouch, a dispensing extension to the surrounding sidewall in a nozzle form with the tip extending outwardly from the surrounding sidewall and having a flow passageway in fluid communication with the interior.

14. The article of claim 1, wherein the pouch includes a longitudinal axis and an interior, the pouch including a surrounding sidewall, a first closure forming a downstream end of the pouch and a second closure forming an upstream end of the pouch, a dispensing extension to the surrounding sidewall in an expressing shape nozzle form with the tip extending outwardly from the sidewall and having a flow passageway in fluid communication with the interior and a sealant contained in the interior of the pouch, the sidewall being fabricated out of a flexible material whereby the pouch may be manually folded to squeeze the sealant as an applied bead out of the expressing shaped nozzle and onto a selected substrate surface.

* * * * *